United States Patent [19]

Mortoly

[11] 4,052,046

[45] Oct. 4, 1977

[54] JAW ADAPTER FOR A CLAMP

[75] Inventor: John L. Mortoly, Poughkeepsie, N.Y.

[73] Assignee: James L. Taylor Mfg. Co., Poughkeepsie, N.Y.

[21] Appl. No.: 690,520

[22] Filed: May 27, 1976

[51] Int. Cl.[2] ..... B25B 1/24

[52] U.S. Cl. ..... 269/208; 269/258; 269/285

[58] Field of Search ..... 269/250–253, 269/258, 263, 264, 285, 207–209; 254/2 B

[56] References Cited

U.S. PATENT DOCUMENTS

| | | | |
|---|---|---|---|
| 1,411,013 | 3/1922 | Gilmore | 269/285 |
| 1,670,297 | 5/1928 | Billstrom | 269/208 |
| 3,575,405 | 4/1971 | Harding | 269/258 |
| 3,768,778 | 10/1973 | Arnes | 254/2 B |

*Primary Examiner*—Robert C. Watson
*Attorney, Agent, or Firm*—William V. Ebs

[57] ABSTRACT

A jaw adapter for use with exceptionally thick stock is provided for a clamp in which two jaws are moved along rails relative to each other to clamp boards between them. Such jaw adapter includes a pair of parallel plates with face plate supporting arms to abut and extend above a jaw of the clamp, and includes rollers rotatably mounted in the plates to extend transversely of the rails and support the jaw adapter thereon.

12 Claims, 4 Drawing Figures

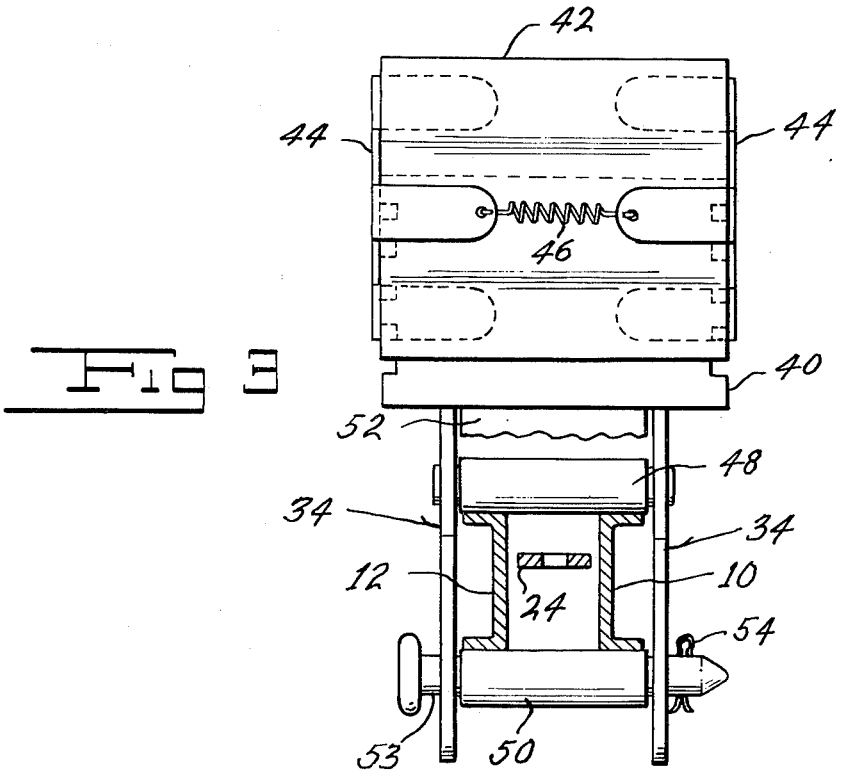
Fig 3
Fig 4
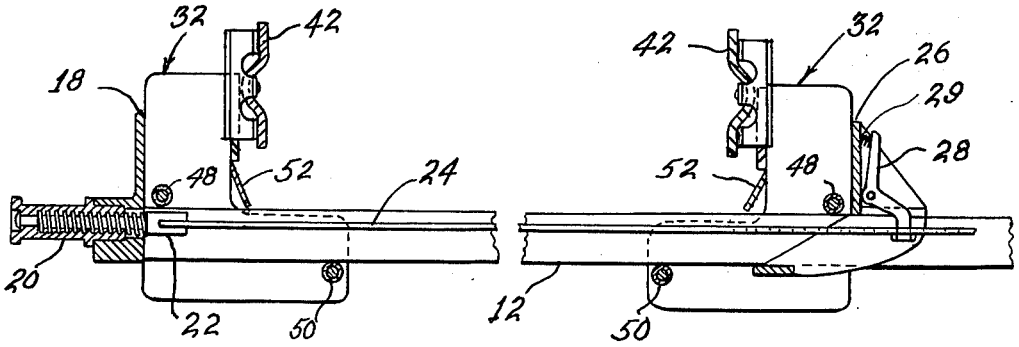

JAW ADAPTER FOR A CLAMP

BACKGROUND OF THE INVENTION

This invention relates to clamps comprising a frame having parallel rigid rails on which are mounted a fixed jaw and a screw — actuated movable jaw, the movable jaw being slidable on the rails to clamp between the jaws pieces of stock to be glued together for use, as for example, in clamp carriers such as shown in U.S. Pat. Nos. 1,653,035, 1,702,036 and 3,488,046.

To provide for the effective clamping of thick stock, as for example while gluing together or laminating into panels boards that will stand six inches high on the rails and extend above the jaws, each jaw may be provided in the manner shown and described in my copending application for "Clamp with Rockable Jaw Face Plate", Ser. No. 647041, filed Jan. 17, 1976, with a vertically adjustable face plate which can be positioned to center the plate on the stock, the plates each being rockable about a horizontal axis between upper and lower edges to engage the stock and distribute pressure practically evenly to upper and lower edge portions of the board stock.

The construction of said patent application is not entirely satisfactory, however, for use with exceptionally thick stock, as for example eight inch wide boards which would extend above the jaws of the clamp a distance not permitting the face plates to be centrally located on the boards and would result in large clamping forces being exerted through the face plates against top edge portions of the jaws.

SUMMARY OF THE INVENTION

For exceptionally thick stock to be held between relatively movable jaws of a clamp there is provided in accordance with the invention, a novel jaw adapter to engage a jaw of the clamp and the stock. The jaw adapter is constructed to engage the stock, as for example with an adjustable face plate positionable midway between top and bottom edges of the material, and includes means to engage the frame and support the jaw adapter for movement on the clamp. The frame engageable means includes a member disposed to resist by reacting with the frame, tilting of the jaw adapter in the direction of the jaw and so prevent the application of load primarily to the upper portion of the jaw during the clamping of the stock.

It is a prime object of the invention to provide a jaw adapter with which especially thick stock can be effectively clamped between relatively movable jaws of a clamp.

It is another object of the invention to provide for use in the clamping of especially thick stock, a jaw adapter which can be moved along the frame of a clamp with a minimum amount of frictional resistance.

It is still another object of the invention to provide for use in the clamping of especially thick stock, a jaw adapter which applies load to the front ace of a jaw without concentrating forces on the jaw at or near the top edge portion.

Other objects and advantages of the invention will become apparent during a reading of the specification taken in conjunction with the accompanying drawings.

DESCRIPTION OF THE DRAWINGS

FIG. 3 is an enlarged front elevational view taken on the plane of the line 3 — 3 of FIG. 1;

FIG. 4 is a sectional view on a reduced scale taken on the plane of the line 4 — 4 of FIG. 2.

DESCRIPTION OF THE PREFERRED EMBODIMENT

Figures 1, 2:
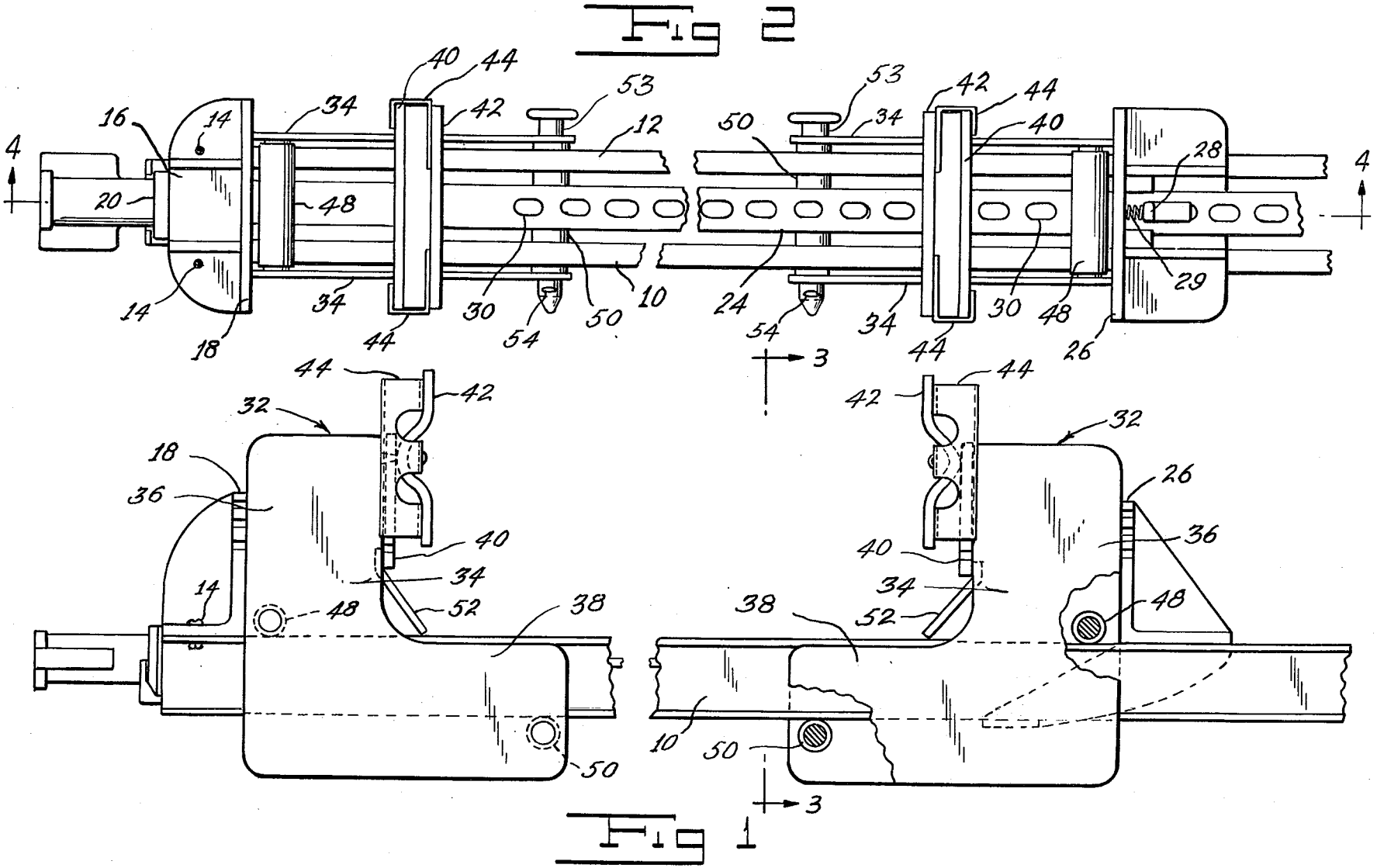
FIG. 1 is a side elevational view of a clamp including jaw adapters constructed in accordance with the invention.
FIG. 2 is a top plan view of the clamp of FIG. 1.

Referring to FIG. 1 to 5 of the drawings, wherein the invention, for the purposes of explanation, is disclosed as embodied in a type of clamp shown in U.S. Pat. No. 1,529,281 of J. L. Taylor, such clamp may be seen as including a pair of spaced parallel rails 10 and 12. The rails are rigidly connected at one end as by bolts 14 to a head 16 providing a fixed clamp jaw 18, and at their other ends are rigidily secured together as by bolts and a spacer block (not shown) which may be formed for connection to the cross rods of a clamp carrier such as shown in U.S. Pat. No. 1,320,808 of J. L. Taylor. The head 16 carries a known type of screw mechanism 20 such as shown in U.S. Pat. No. 3,488,046 which is connected at 22 to a draw bar 24 for a movable jaw 26 slidably mounted on the rails 10 and 12 to move toward and away from the fixed jaw for clamping stock to be glued between the jaws. The movable jaw 26 is adjustably connected to the draw bar by a latch 28 pivotally mounted between its ends on the movable jaws and having a free end normally biased by a spring 29 into any one of a plurality of holes 30 in the draw bar 24.

Each of the jaws 18 and 26 is provided with a jaw adapter 32 which is constructed according to the invention and may be substantially the same for both jaws. Each jaw adapter includes like parallel side plates 34 with mutually perpendicular arms 36 and 38. One of the side plates 34 of each jaw adapter is located to one side of the guide rails of the clamp and the other side plate is located on the other side of the rails as shown.

The arms 36 of each jaw adapter extend upright from the rails and have a plate 40 welded or otherwise suitable secured to them. A face plate 42, such as shown for example in the aforementioned copending patent application Ser. No. 647,041, is attached to plate 40 and both are supported on the arms 36. The face plate 42 is attached to plate 40 for rocking motion as with identical brackets 44 and a spring 46 in the manner of said patent application such that the plate 42 may rock about a horizontal axis between upper and lower edges to engage and distribute pressure practically evenly to upper and lower edges of clamped board stock. The brackets 44 may be rendered vertically adjustable on plate 40 in the manner shown in said patent application to accomodate the face plate 42 to different heights of stock. The arms 36 rotatably support a roller 48 in a position to contact the top side of rails 10 and 12. Arms 38 of each jaw adapter extend parallel to the rails 10 and 12 and rotatably suport a roller 50 in a position to contact the bottom side of the rails. A transverse member 52 affixed to plate 40 on each jaw adapter and in contact with the top side of the rails 10 and 12 prevents during the absence of any clamping force on the jaw adapter, any pivoting thereof on the rails of the clamp in a direction tilting the arms 34 away from the jaws of the clamp.

During the clamping of board stock the stock is engaged by the rockable face plate 42 on the front of each jaw adapter 32 and back edges of the jaw adapters engage the jaws of the clamp. The jaws 18 and 26 are each engaged throughout their entire height as shown. Rollers 50 resist any tendency of the jaw adapters to pivot on the rails in a direction tending to urge the arms 36 against the top edge portions of the jaws. Clamping forces are therefor distributed substantially evenly throughout the height of the jaws where contacted by the jaw adapters. By avoiding the application of clamping pressure primarily to the top edge portions of the jaws of the clamp the liklihood of the jaws being damaged in use is slight. Also because of the way in which the jaw adapters are mounted on the rails 10 and 12, that is, with the rollers 48 and 50, the jaw adapters may be moved on the rails with little frictional resistance and greater clamping force than would otherwise be possible can be exerted on stock between them.

The rollers 50 may be readily detached from the jaw adapters 32 by pulling the roller shafts 53 out of the side plates 34 after first removing cotter pins 54, and in this way the jaw adapters are prepared for removal from or attachment to the claim.

Although a preferred form or the invention has been shown and described herein it is to be understood that various changes in and modifications of the disclosed construction may be made by one skilled in the art without departing from the spirit and scope of the invention. In particular the jaw adapters may be constructed to engage the jaws at lower edge portions to permit clamping forces to be transmitted to lower parts of the jaws rather than throughout their entire height. Also, pins affixed in the arms 36 may be substituted for the rollers 48, and as a further economy measure other pins detachable from and preferably rotatable in the arms 38 may be used in place of the rollers 50. Numerous other changes and modifications will occur to persons skilled in the art and are within the spirit and scope of the invention as defined by the annexed claims.

I claim:

1. A jaw adapter to mount upon the frame of a clamp having relatively movable jaws and increase the effective height of one of the jaws during the clamping of stock between them, the jaw adapter having a front side engageable above the jaws with clamped stock and having a rear side engageable with the face of said one jaw, the jaw adapter including means to contact the frame and facilitate longitudinal movement of the jaw adapter thereon, said means including a member disposed to resist by transversely engaging the frame any tendency of the upper part of the jaw adapter to tilt against said one jaw and concentrate force at the upper portion of said one jaw during the clamping of stock.

2. A jaw adapter as defined in claim 1 including a member engageable with the frame to prevent tilting of the jaw adapter in the absence of clamping force thereon in a direction which would result in the upper part of the jaw adapter moving away from said one jaw.

3. The jaw adapter of claim 1 formed to engage said one jaw along substantially the entire height of the face thereof.

4. The jaw adapter of claim 1 including a rockable face plate to engage the stock.

5. The jaw adapter of claim 4 wherein the face plate is adjustable thereon into positions for engaging stock at different heights on the clamp.

6. The combination of claim 1 wherein said member is rotatable in the jaw adapter.

7. The combination of claim 6 wherein said member is detachable from the jaw adapter.

8. The jaw adapter of claim 1 wherein the frame includes parallel side plates which span the rails, and said frame contacting means includes a pair of rollers one of which is the said member, the rollers being supported in the plates to extend transversely of the rails and contact opposite sides thereof.

9. The combination of claim 8 wherein each of said plates is right - angular in shape with mutually perpendicular arms, one to extend parallel to the rails and the other to extend upright and contact along a rear edge thereof said one jaw.

10. In a clamp, the combination of a frame including rigidly connected spaced rails, a fixed jaw and a movable jaw on the rails to receive stock between the jaws, means for moving said movable jaw toward and away from said fixed jaw to clamp and release said stock respectively, a jaw adapter for each jaw mounted on said rails and including a rockable plate on its front side, engageable above the jaw with the stock to increase the effective height of the jaw during the clamping of stock, such jaw adapter being engageable on the rear side with the front of the jaw, each of the jaw adapters including means extending transversely of and in contact with the rails to facilitate longitudinal movement of the jaw adapters thereon, said means on each jaw adapter including a rotable member disposed therein to resist by engagement with the rails, when stock is clamped, any tendency of the upper part of the jaw adapter to tilt against the jaw and concentrate force at the upper portion thereof.

11. In a clamp as defined in claim 10, means on each jaw adapter and in contact with the rails to prevent the jaw adapter from tilting in a direction such as to move the jaw adapter away from the upper part of the jaw when the stock is released.

12. The combination of claim 10 wherein the said rotatable member resists said tilting tendency of the jaw adapter by reacting with the bottom side of the rails and the rail contacting means includes a second rotatable member in contact with the top side of the rails.

* * * * *